US010669658B2

(12) United States Patent
Tsai

(10) Patent No.: US 10,669,658 B2
(45) Date of Patent: Jun. 2, 2020

(54) ELECTRONIC YARN CHANGING DEVICE FOR CIRCULAR KNITTING MACHINE

(71) Applicant: PAI LUNG MACHINERY MILL CO., LTD., New Taipei (TW)

(72) Inventor: Hsien-Te Tsai, Taoyuan (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 55 days.

(21) Appl. No.: 15/833,368

(22) Filed: Dec. 6, 2017

(65) Prior Publication Data

US 2019/0169771 A1 Jun. 6, 2019

(51) Int. Cl.

| | |
|---|---|
| ***D04B 15/58*** | (2006.01) |
| ***D04B 15/60*** | (2006.01) |
| ***D04B 9/34*** | (2006.01) |
| ***D04B 15/99*** | (2006.01) |
| *D04B 9/30* | (2006.01) |
| *D04B 15/80* | (2006.01) |

(52) U.S. Cl.

CPC ..... *D04B 15/60* (2013.01); *D04B 9/34* (2013.01); *D04B 15/58* (2013.01); *D04B 15/99* (2013.01); *D04B 9/30* (2013.01); *D04B 15/80* (2013.01)

(58) Field of Classification Search

CPC ..... D04B 15/58; D04B 15/99; D04B 15/40; D04B 15/60; D04B 15/80; D04B 15/00; D04B 15/02; D04B 15/06; D04B 15/61; D04B 15/62; D04B 9/34; D04B 9/30

USPC ..... 66/133, 134, 138, 139, 140 R

See application file for complete search history.

(56) References Cited

U.S. PATENT DOCUMENTS

| | | | | |
|---|---|---|---|---|
| 3,613,404 A * | 10/1971 | Ernst-Dieter Plath | | D04B 15/58 66/120 |
| 4,137,732 A | 2/1979 | Gostelow et al. | | |
| 4,193,274 A | 3/1980 | Gostelow | | |
| 4,385,507 A | 5/1983 | Sawazaki | | |
| 5,046,333 A * | 9/1991 | Sawazaki | | D04B 15/58 66/140 R |

(Continued)

FOREIGN PATENT DOCUMENTS

JP 2005042260 A 2/2005

*Primary Examiner* — Danny Worrell
*Assistant Examiner* — Dakota Marin
(74) *Attorney, Agent, or Firm* — Muncy, Geissler, Olds & Lowe, P.C.

(57) ABSTRACT

An electronic yarn changing device for a circular knitting machine includes at least two driving units, at least two impelling plates respectively connected to the driving units, and at least two yarn feeding units. The impelling plates are impelled by the respective connected driving units to perform a one-dimensional motion. The yarn feeding units are arranged side by side, and are each provided sequentially with a yarn feeding plate, a yarn clamping plate, a mobile blade plate and a fixed blade plate. The yarn clamping plate includes a plurality of guide columns disposed correspondingly to the yarn feeding plate. The yarn feeding plates are respectively pushed by the corresponding impelling plates to perform a two-dimensional motion due to the plurality of guide columns. The mobile blade plates are also respectively pushed when the corresponding impelling plates perform the one-dimensional motion, and individually perform a one-dimensional motion once being pushed.

12 Claims, 13 Drawing Sheets

(56) References Cited

U.S. PATENT DOCUMENTS

| | | | | |
|---|---|---|---|---|
| 5,218,845 | A * | 6/1993 | Wang | D04B 15/58 66/133 |
| 5,222,380 | A * | 6/1993 | Lonati | D04B 15/00 66/216 |
| 5,251,463 | A * | 10/1993 | Lonati | D04B 15/58 66/140 R |
| 6,655,176 | B1 * | 12/2003 | Wang | D04B 15/58 66/139 |
| 6,688,140 | B2 * | 2/2004 | Shibuta | D04B 7/28 66/148 |
| 7,055,348 | B1 * | 6/2006 | Wei | D04B 15/58 66/134 |
| 7,607,324 | B2 | 10/2009 | Lonati | |
| 7,690,224 | B1 * | 4/2010 | Wei | D04B 15/60 66/140 R |
| 7,836,731 | B2 | 11/2010 | Lonati et al. | |
| 7,861,559 | B2 * | 1/2011 | Lonati | D04B 15/60 66/140 R |
| 9,441,317 | B1 * | 9/2016 | Lee | D04B 15/60 |
| 9,683,321 | B2 | 6/2017 | Lonati et al. | |
| 2016/0130735 | A1 * | 5/2016 | Lonati | D04B 15/38 66/145 R |

* cited by examiner

ELECTRONIC YARN CHANGING DEVICE FOR CIRCULAR KNITTING MACHINE

FIELD OF THE INVENTION

The present invention relates to an electronic color-changing yarn changing device for a circular knitting machine.

BACKGROUND OF THE INVENTION

Current electronic yarn changing devices for a circular knitting machine are as disclosed by the U.S. Pat. Nos. 4,137,732, 4,193,274, 4,385,507, 7,607,324, 7,836,731, 7,861,559 and 9,683,321, and the Japanese Patent Application No. 2005-042260.

With respect to the U.S. Pat. No. 7,861,559, the patent discloses a yarn feeding device for a circular knitting machine. The device includes a supporting element, which is arranged on the inner side of the machine bed and supports a set of yarn guides arranged side-by-side. Each of the yarn guides comprises a passage for at least one yarn to be fed to the needles of the machine arranged in the bed and the supporting element. Further, for each of the yarn guides, the supporting element supports an element for clamping and cutting the yarn dispensed by the corresponding yarn guide. A first member for actuating the yarn guides is provided to produce their passage from an inactive position, in which they are arranged so that their passage lies on the inner side of the knitting bed, to an active position, in which they are arranged so that their passage lies on the outer side of the needle bed, or vice versa, producing the passage of the yarn guides from the active position to the inactive position. A second member is provided for actuating the clamping and cutting elements and producing the passage for the clamping and cutting elements from a position for clamping the yarn to a position for waiting for the yarn to be clamped. The first actuating member is also configured on the supporting member and includes individual actuators. The individual actuators can be actuated to produce the passage of each of the yarn guides from the inactive position to the active position or vice versa, or vice versa, from the active position to the inactive position. Although having significantly reduced the using of a linking rod structure, the above patent includes a complex driving structure. More specifically, the patent utilizes two pneumatic tanks for performing the control of yarn feeding plates, and utilizes an additional independent pneumatic tank to control the mobile blade plate. Thus, due to the driving structure, the electronic yarn changing device of the above patent cannot provide a simplified overall structure.

SUMMARY OF THE INVENTION

It is a primary object of the present invention to solve the issue of a complex structure of a conventional solution.

To achieve the above object, the present invention provides an electronic yarn changing device for a circular knitting machine. The electronic yarn changing device includes at least two driving units, at least two impelling plates, and at least two yarn feeding units. The driving units are individually controlled by an electronic signal. Each of the impelling plates is respectively assembled to one of the driving units. Each of the impelling plates includes at least one connecting portion mounted with the driving unit, an extension portion extending from the connecting portion and parallel to a motion direction of the impelling plate, and two pushing portions respectively extending from the extending portion, spaced by a first distance and perpendicular to the motion direction of the impelling plate. The yarn feeding units are arranged side by side. Each of the yarn feeding units sequentially includes a yarn feeding plate, a yarn clamping plate, a mobile blade plate and a fixed blade plate. The yarn feeding plate includes a curved portion that has a length equal to the first distance and is parallel to the motion direction of the impelling plate, and a yarn feeding portion extending from the curved portion and perpendicular to the motion direction of the impelling plate. The yarn clamping plate includes a plurality of guide columns disposed correspondingly to the curved portion and performing a two-dimensional motion when pushed by the impelling plate, and two through holes disposed correspondingly between the two pushing portions. The mobile blade plate includes a body portion, a cutting blade portion extending from the body portion and perpendicular to the motion direction of the impelling plate, and two control rods provided on the body portion and respectively protruding towards the two through holes to cause the mobile blade plate to be driven by one of the pushing portions and to perform a one-dimensional motion. A second distance smaller than the first distance is present between the two control rods.

In one embodiment, each of the driving units is a pneumatic tank.

In one embodiment, the pneumatic tank includes a tank and a pushing rod penetrating the tank, the impelling plate includes two of the connecting portions, and the two connecting portions are spaced and are respectively connected to ends of the pushing rod.

In one embodiment, the clamping plate and the fixed blade plate respectively comprise a plurality of installation holes, and each of the plurality of guide columns is formed by a horizontal shaft penetrated through the plurality of installation holes which are located on the same axis line.

In one embodiment, these driving units are arranged in a matrix.

In one embodiment, the electronic yarn changing device includes an electrical control unit connected to the driving units.

In one embodiment, the electronic yarn changing device includes two protective casing plates, which are disposed on two opposite outer sides of the yarn feeding units, respectively.

In one embodiment, each of the driving units is a stepping motor.

In one embodiment, the stepping motor includes an output shaft and a gear disposed at an end of the output shaft, and the connecting portion of the impelling plate is a rack.

With the foregoing embodiments, the present invention provides following features compared to prior art. In the present invention, each of the yarn feeding units, requiring only one of the driving units, is capable of completing the yarn dispensing operation and the yarn withholding operation, thus more substantially simplifying the structure of the electronic yarn changing structure.

DETAILED DESCRIPTION OF THE PREFERRED EMBODIMENTS

Figure 1:
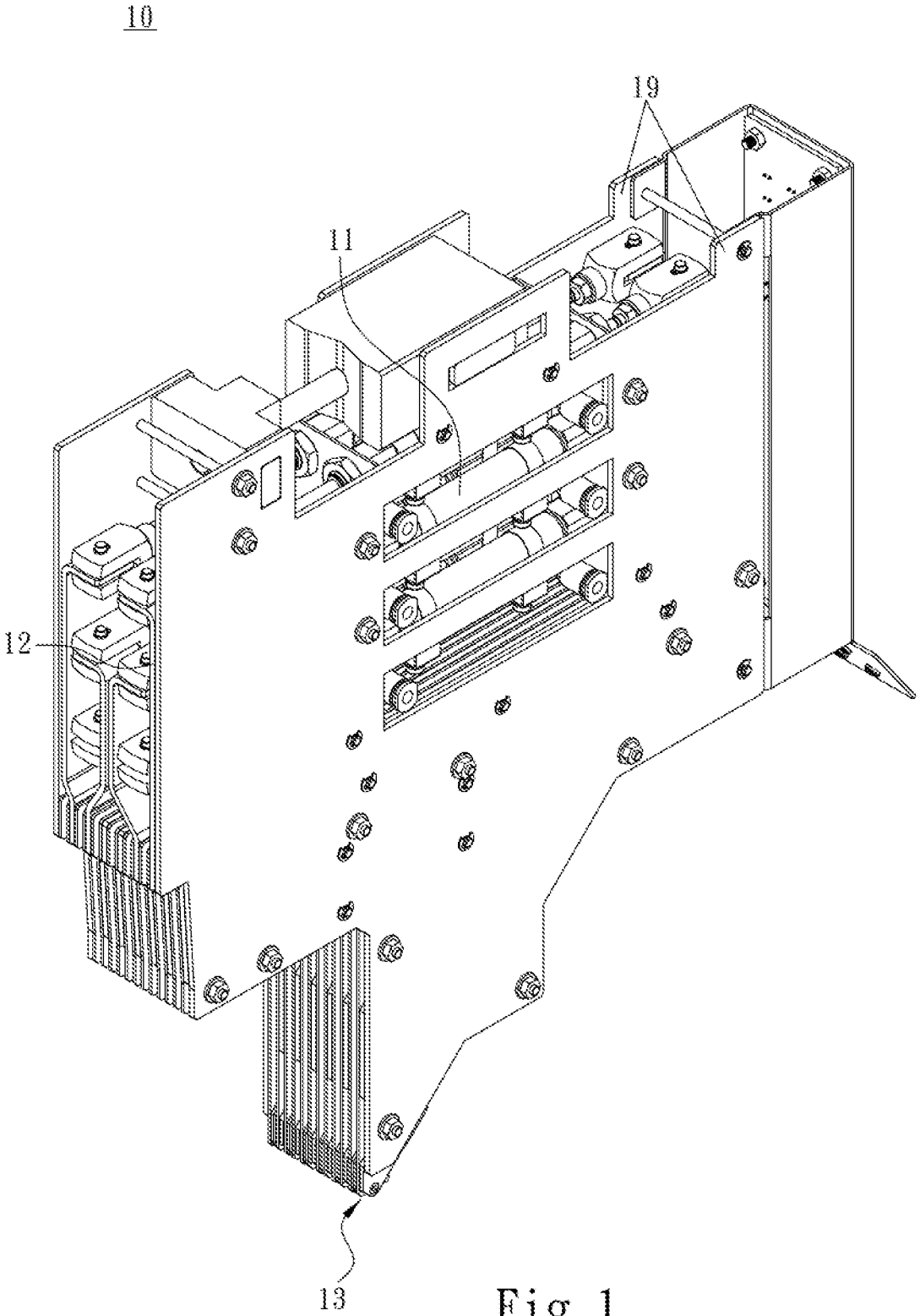
FIG. 1 is a schematic diagram of a structure according to an embodiment of the present invention.
Figure 2:
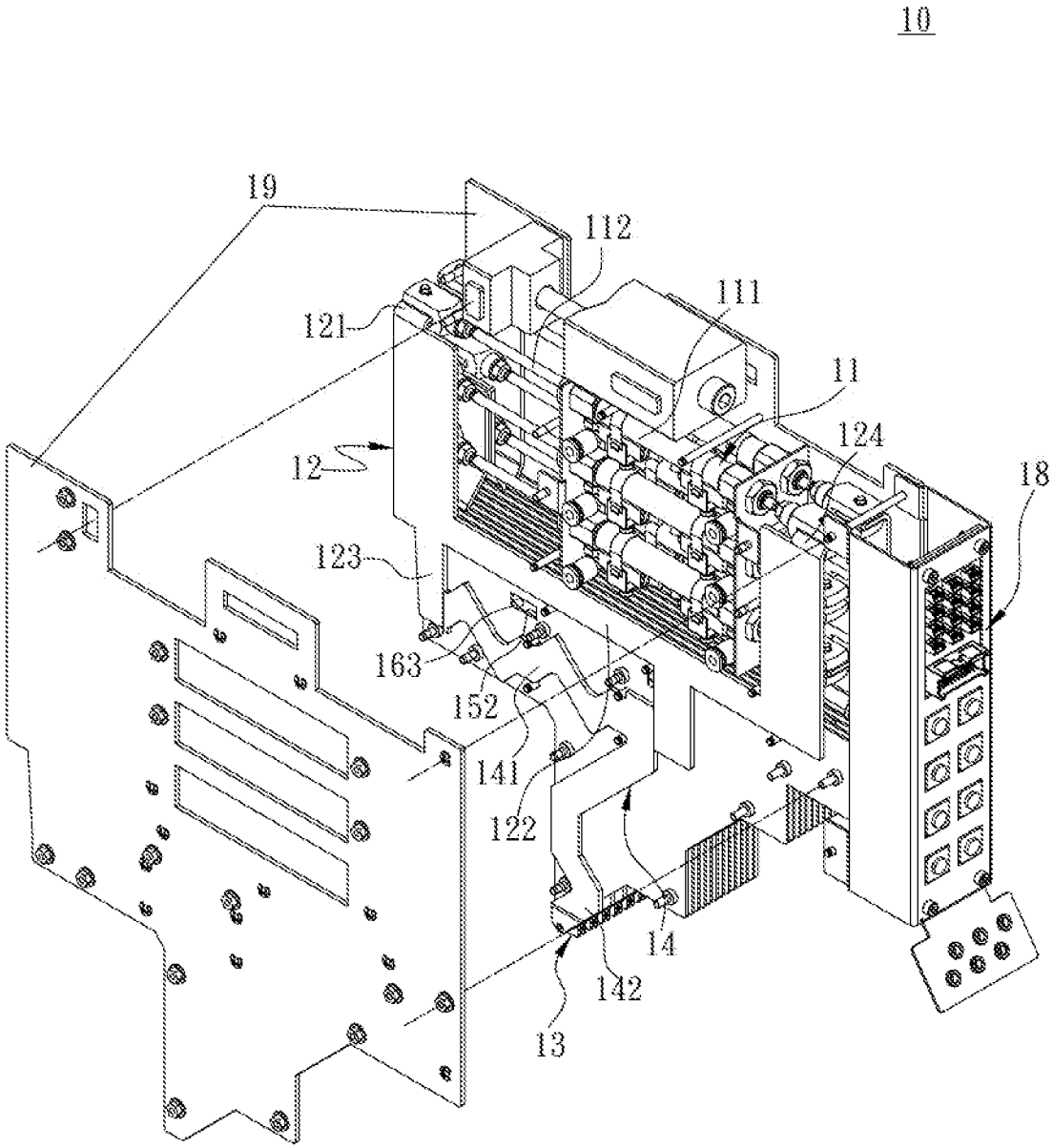
FIG. 2 is a first exploded schematic diagram of a partial structure according to an embodiment of the present invention.

Details and technical contents of the present invention are given with the accompanying drawings below.

Referring to FIG. 1, FIG. 2, FIG. 3, FIG. 4 and FIG. 5, the present invention provides an electronic yarn changing device 10 for a circular knitting machine. The electronic yarn changing device 10 is used for color-changing yarn changing during a weaving process of the circular knitting machine, and includes at least two driving unit 11, at least two impelling plates 12 and at least two yarn feeding units 13. The numbers of the driving units 11, the impelling plates 12 and the yarn feeding units 13 can be adjusted according to the number of yarns for color changing configured to the electronic yarn changing device 10. For example, when the electronic yarn changing device 10 is configured to perform six-color yarn changing, the numbers of the driving units 11, the impelling plates 12 and the yarn feeding units 13 are individually six in number. In the present invention, an example of the electronic yarn changing device 10 performs two-color yarn changing is given, and the present invention is not limited thereto.

Each of the driving units 11 is controlled by an electronic signal, and performs a corresponding operation after having received the electronic signal. The electronic signal may be a yarn changing signal inputted into weaving process information of the circular knitting machine, and the yarn changing signal may be interpreted as a yarn dispensing operation or a yarn withholding operation. On the other hand, each of the impelling plates 12 is driven by one of the driving units 11 to perform a one-dimensional motion. Each of the impelling plates 12 includes at least one connecting portion 121 mounted with the driving unit 11, an extension portion 122 extending from the connecting portion 121 and parallel to a motion direction of the impelling plate 12, and two pushing portions 123 individually extending from the extension portion 122, spaced by a first distance 90 and perpendicular to the motion direction of the impelling plate 12. Further, the yarn feeding units 13 are arranged side by side, and each of the yarn feeding units 13 is provided sequentially with a yarn feeding plate 14, a yarn clamping plate 15, a mobile blade plate 16 and a fixed blade plate 17. The yarn feeding plate 14 includes a curved portion 141 that has a length equal to the first distance 90 and is parallel to the motion direction of the impelling plate 12, and a yarn feeding portion 142 extending from the curved portion 141 and perpendicular to the motion direction of the impelling plate 12. The yarn feeding portion 142 is for placing a yarn. The yarn clamping plate 15 includes a plurality of guide columns 151 disposed correspondingly to the curved portion 141 such that the yarn feeding plate 14 is caused to perform a two-dimensional motion when pushed by the impelling plate 12, and two through holes 152 correspondingly provided between the two pushing portions 123. The mobile blade plate 16 includes a body portion 161, a cutting blade portion 162 extending from the body portion 161 and perpendicular to the motion direction of the impelling plate 12, and two control rods 163 provided on the body portion 161 and respectively protruding towards the two through holes 152 to cause the mobile blade plate 16 to be impelled by one of the pushing portions 123 and to perform a one-dimensional motion. A second distance 91 smaller than the first distance 90 is present between the two control rods 163. More specifically, the length of the mobile blade plate 16 is smaller than that of the yarn feeding plate 14, such that, during the displacement process, the impelling plate 12 first pushes the yarn feeding plate 14 and then pushes the mobile blade plate 16. Further, the electronic yarn changing device 10 includes an electrical control unit 18 connected to the driving units 11. The electrical control unit 18 may be further connected to a computer device to obtain information required for weaving. Alternatively, the electrical control unit 18 includes a memory element (not shown) for a writer to write weaving information. In addition, the electronic yarn changing device 10 further includes two protective casing plates 19 disposed on two opposite outer sides of the yarn feeding units 13.

Figure 6A:
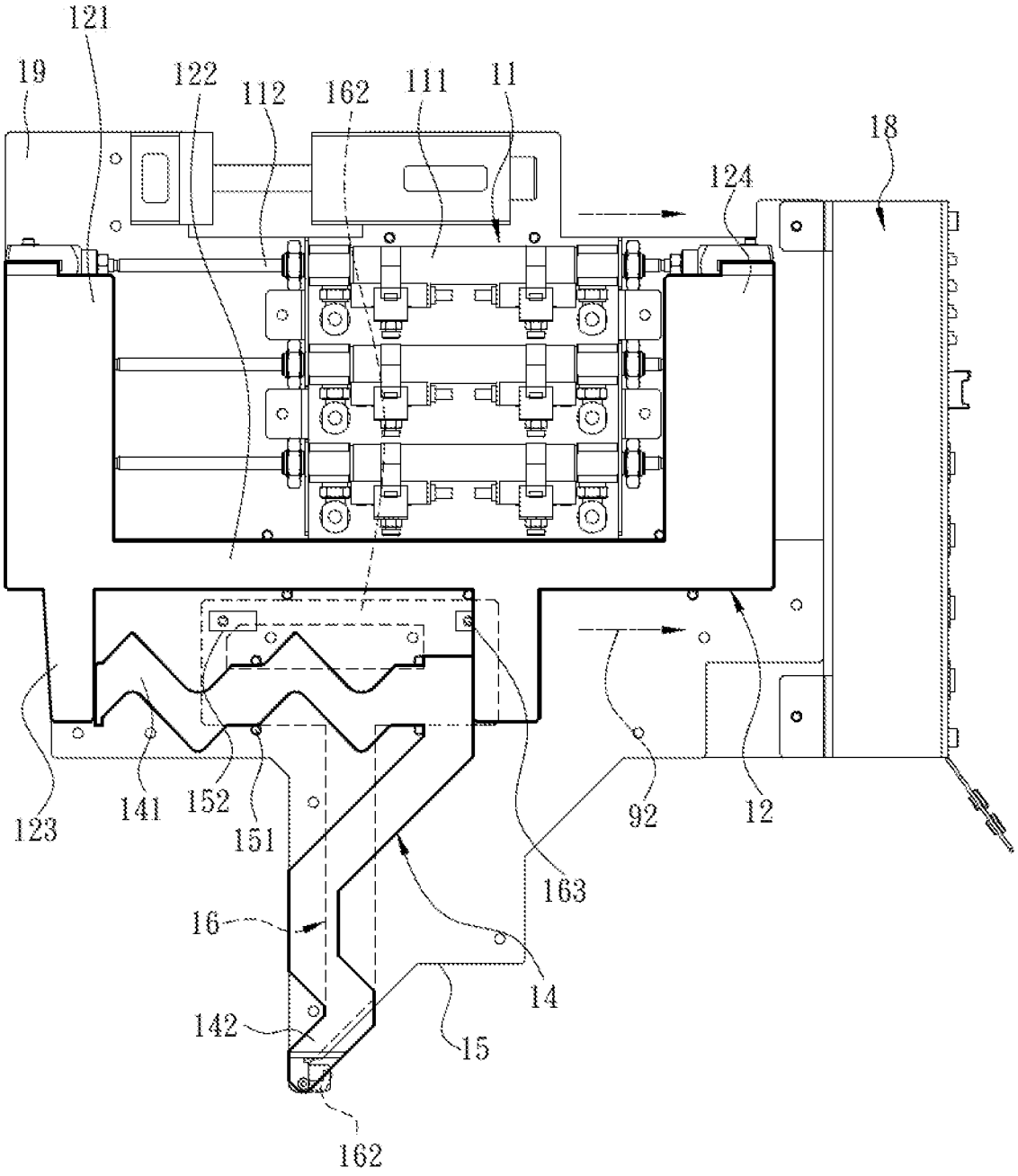
FIG. 6A to FIG. 6C are first to third successive schematic diagrams of a yarn dispensing operation of a yarn feeding unit according to an embodiment of the present invention.
Figure 6B:
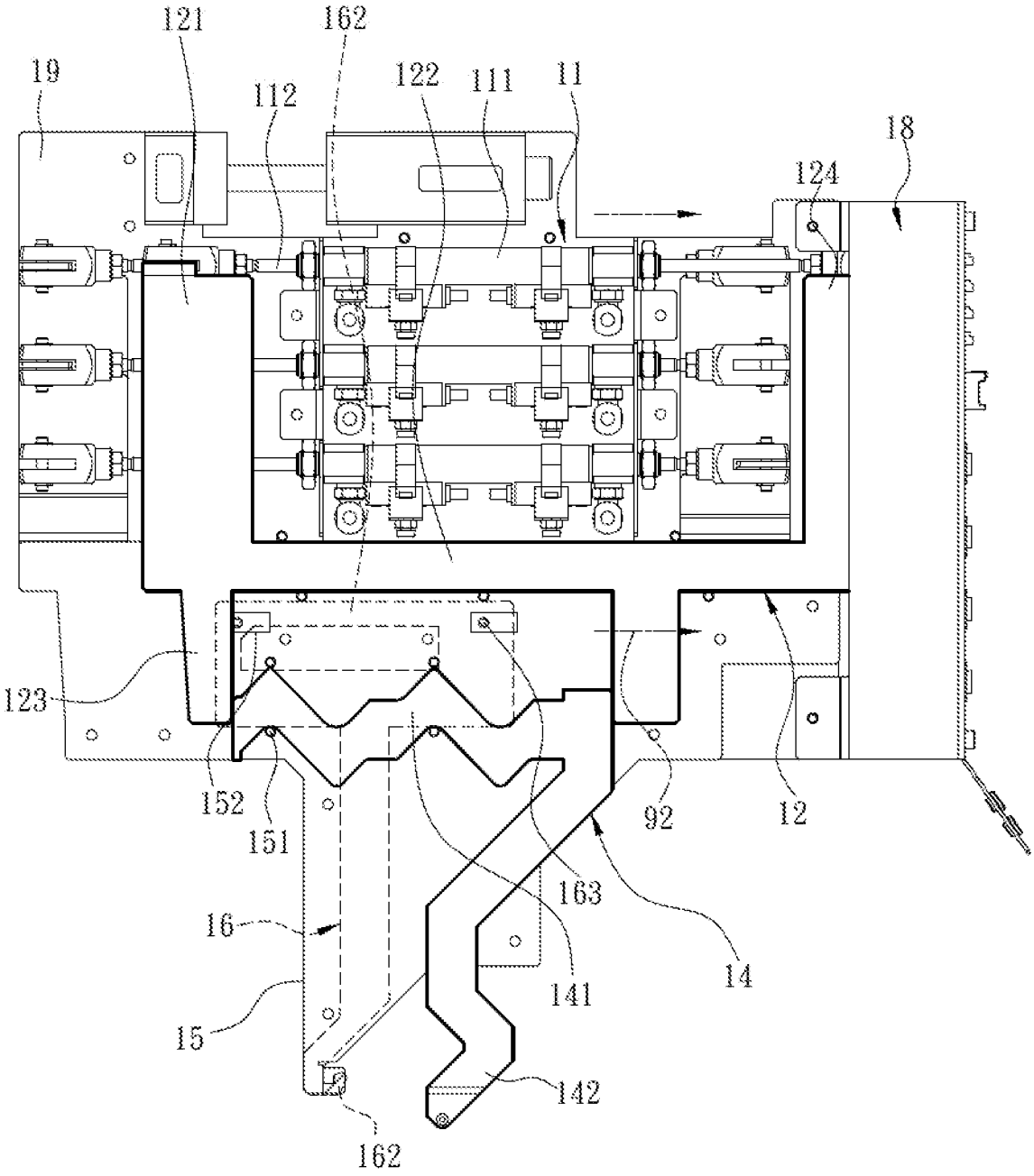
Figure 6C:
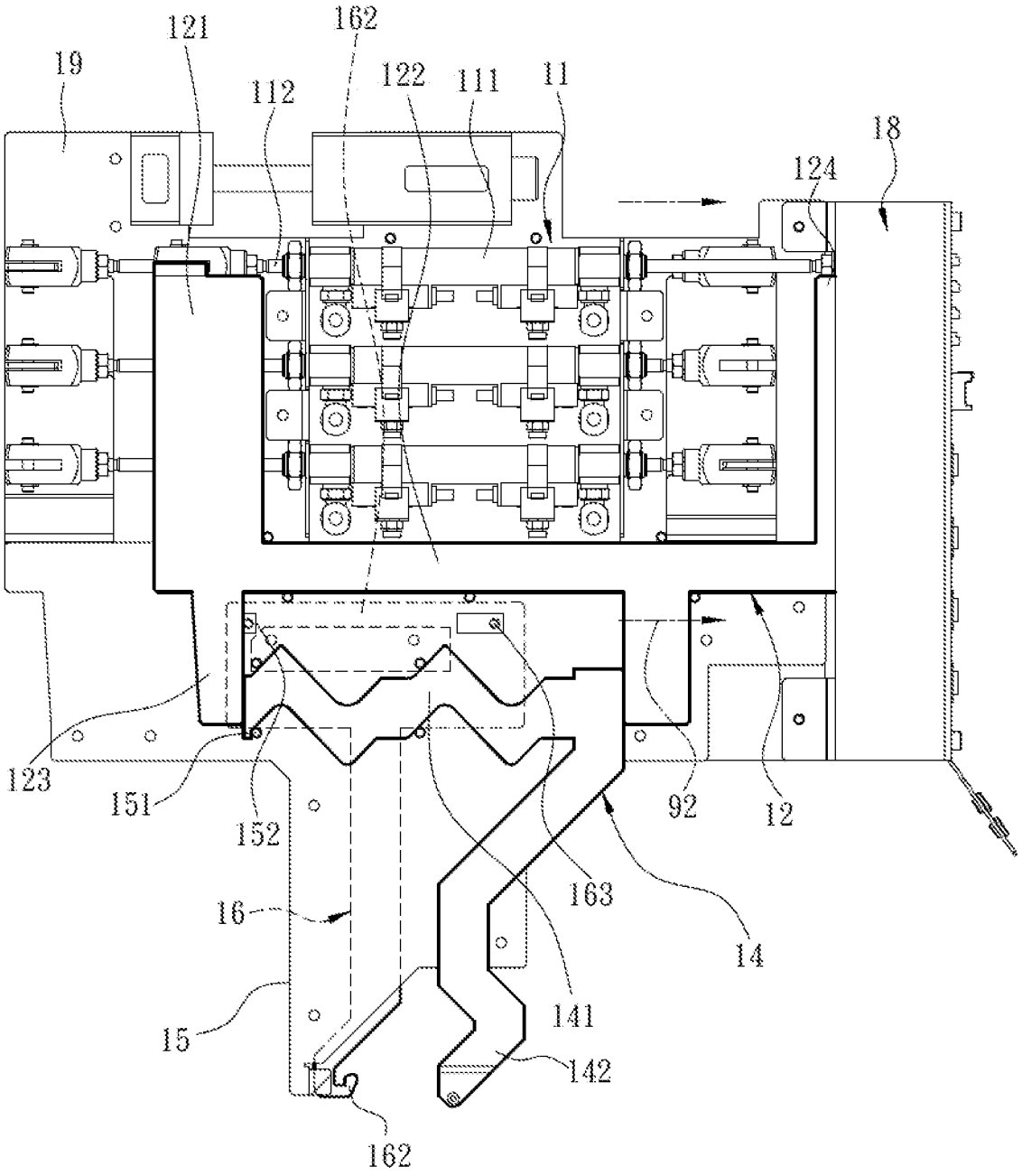

Also referring to FIG. 6A, FIG. 6B and FIG. 6C, each of the feeding units 13 can be controlled to perform the yarn dispensing operation or the yarn withholding operation. When the circular knitting machine performs color-changing yarn changing, more than just one of the yarn feeding units 13 are caused to operate. That is, one of the yarn feeding units 13 providing a yarn of another color first performs the yarn dispensing operation, such that a hook needle (not shown) on the circular knitting machine first hooks the above yarn, and then another of the yarn feeding units 13 originally performing a yarn feeding operation performs the yarn withholding operation. Detailed operations of the components of the electronic yarn changing device 10 while each of the yarn feeding units 13 performs the yarn dispensing operation are given herein. At the beginning of the yarn dispensing operation, the state of the electronic yarn changing device 10 is as shown in FIG. 6A. When the driving unit 11 receives the electronic signal and becomes activated, the impelling plate 12 is pushed by the driving unit 11 to perform a one-dimensional motion to move towards a first direction 92. Meanwhile, the yarn feeding plate 14 is pushed by the impelling plate 12 to also move towards the first direction 92. However, during the displacement process, the yarn feeding plate 14 receives an effect of the plurality of guide columns 151 such that the yarn feeding plate 14 performs a two-dimensional motion according to the pattern of the curved portion 141, allowing the yarn on the yarn feeding plate 14 to enter a working area of the hook needle and be hooked by the hook needle. A final state of the electronic yarn changing device 10 in the yarn dispensing operation is as shown in FIG. 6C.

Figure 7A:
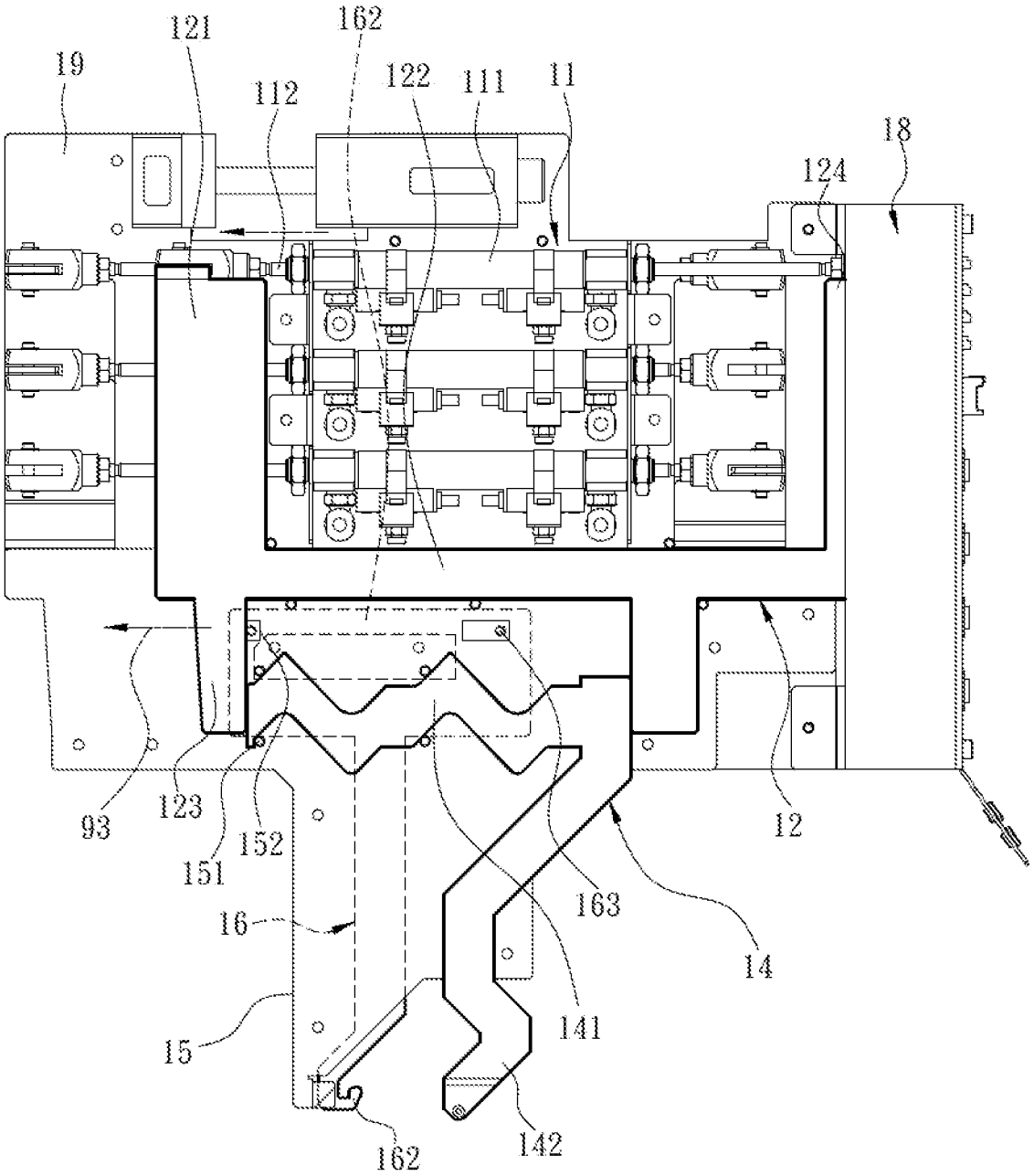
FIG. 7A to FIG. 7C are first to third successive schematic diagrams of a yarn withholding operation of a yarn feeding unit according to an embodiment of the present invention.
Figure 7B:
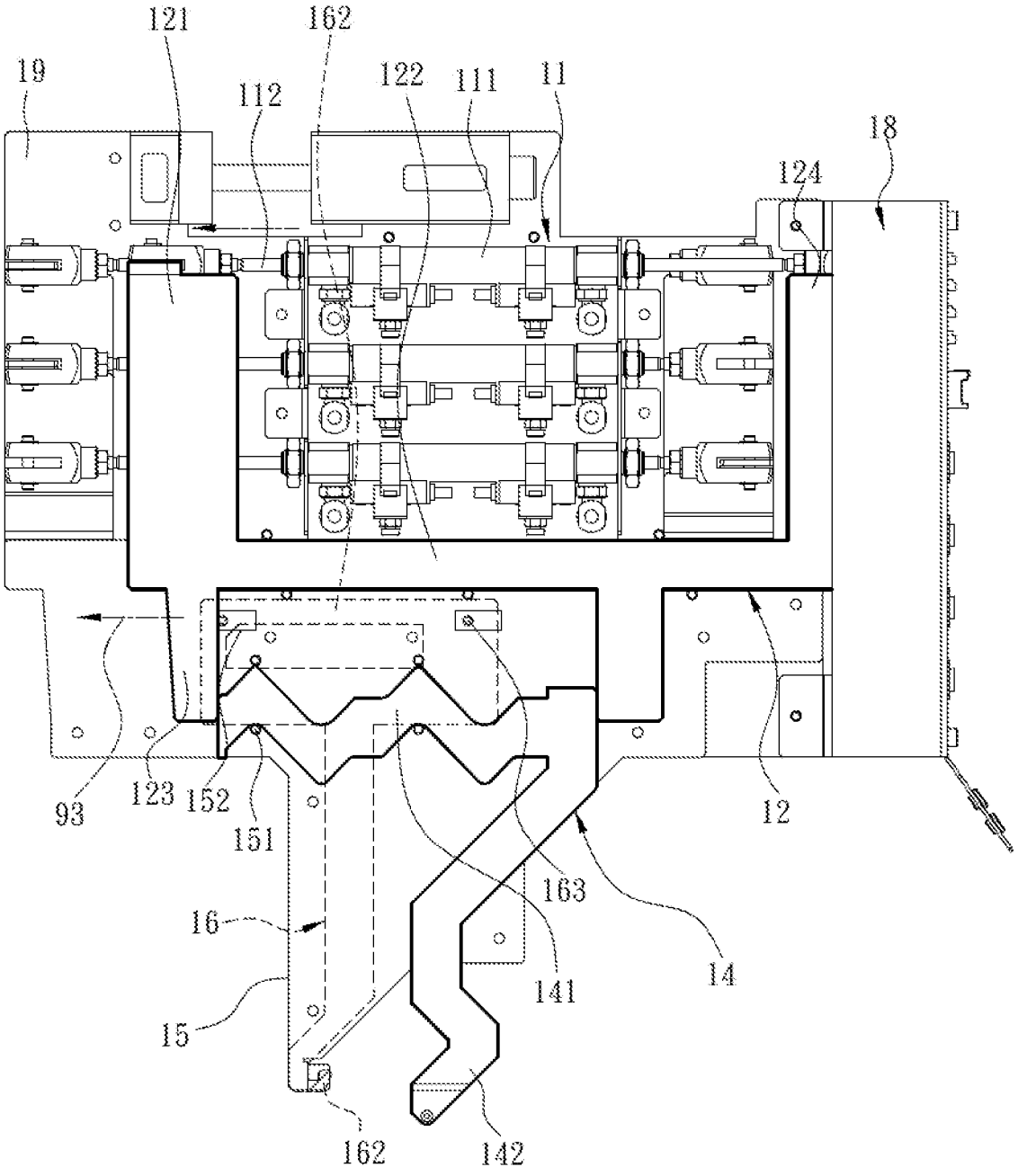
Figure 7C:
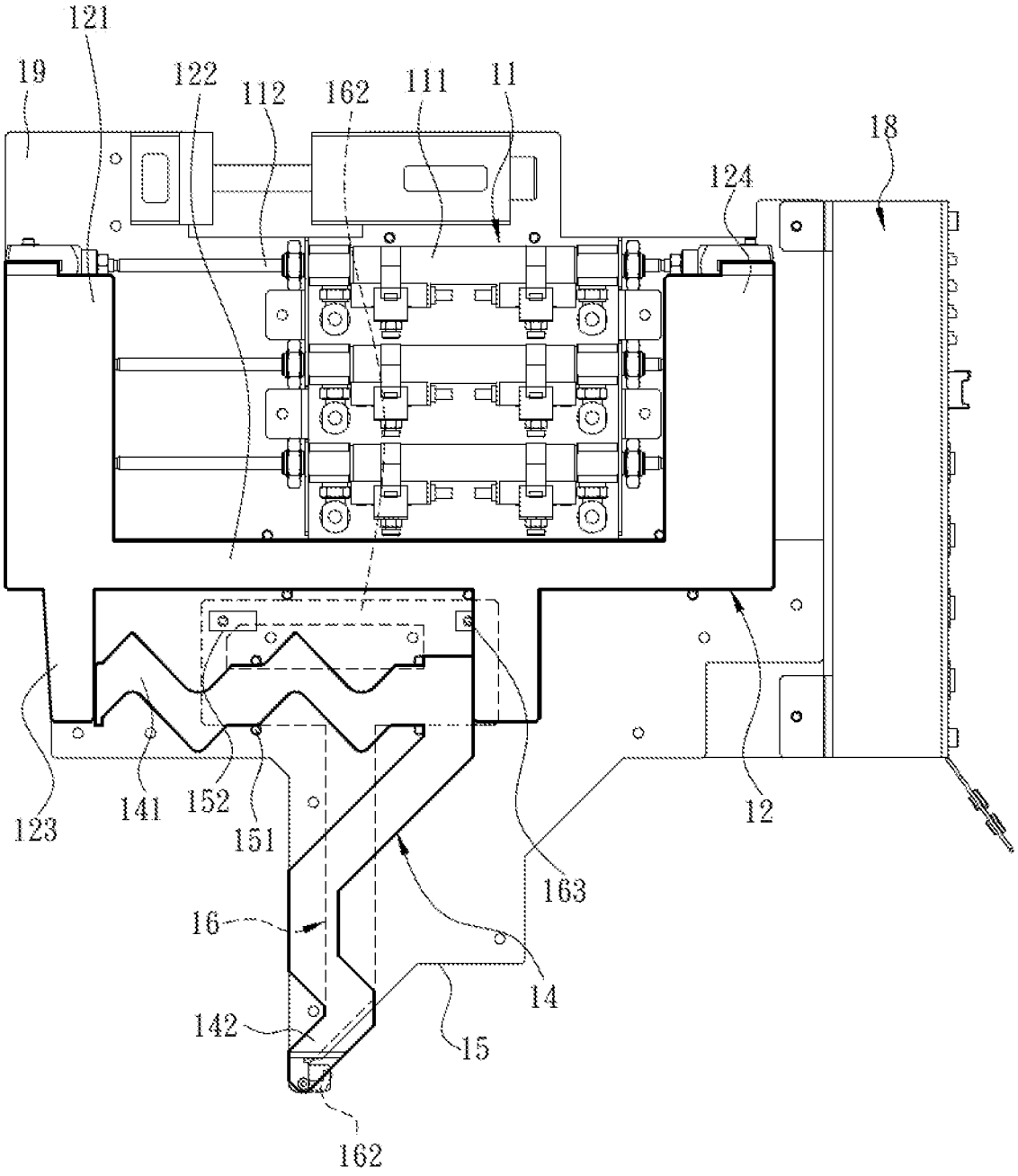

In continuation, when each of the yarn feeding units 13 initially performs yarn withholding operation, the electronic yarn changing device 10 is in fact in the final state of the yarn dispensing operation, as shown in FIG. 7A. At this point, when the driving unit 11 again receives the electronic signal and becomes activated, the impelling plate 12 is pushed by the driving unit 11 to perform a one-dimensional motion to move towards a second direction 93, which is opposite to the first direction 92. Meanwhile, the yarn feeding plate 14 is pushed by the impelling plate 12 to also move towards the second direction 93. During the displacement process, the yarn feeding plate 14 similarly receives the effect of the guide columns 151 such that the yarn feeding plate 14 performs a two-dimensional motion according to the pattern of the curved portion 141, and guides the yarn originally being knitted to move away from the working area of the hook needle, as shown in FIG. 7B and FIG. 7C. Next, during the guiding process of the yarn, the yarn is hooked by the mobile blade plate 16, which moves towards the second direction 93 as the control rod 163 is pushed by the impelling plate 12. The yarn is then clamped between the mobile blade plate 16 and the yarn clamping plate 15, and is then cut off once the mobile blade plate 16 moves to a position where the yarn touches the fixed blade plate 17. More details of the cutting operation can be referred from the U.S. Pat. No. 9,441,317, and shall be omitted herein.

To substantially minimize the thickness of the electronic yarn changing device 10, these driving units 11 are arranged in a matrix. Taking the electronic yarn changing device 10 capable of six-color yarn changing in FIG. 2 for example, these driving units 11 are stacked and arranged in a 2×3 matrix. On the other hand, when these driving units 11 are arranged in a matrix, these impelling plates 12 respectively extend into gaps among these driving units 11, so as to prevent from interfering operations of other components. Further, the arrangement of this embodiment further minimizes the thickness of the electronic yarn changing device 10, further increasing the number of yarns that can be fed by the circular knitting machine.

Figure 8:
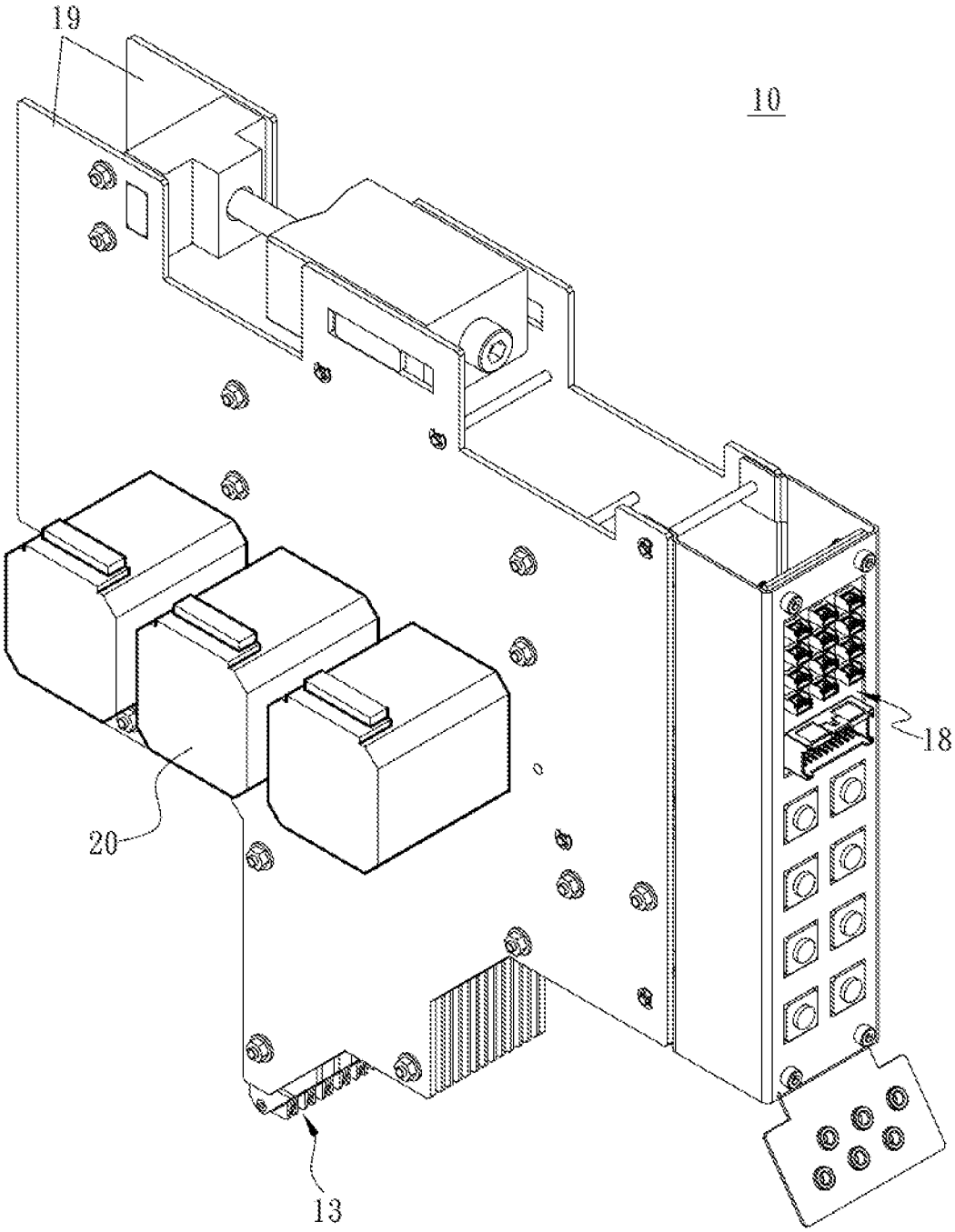
FIG. 8 is a schematic diagram of a structure according to another embodiment of the present invention.
Figure 9:
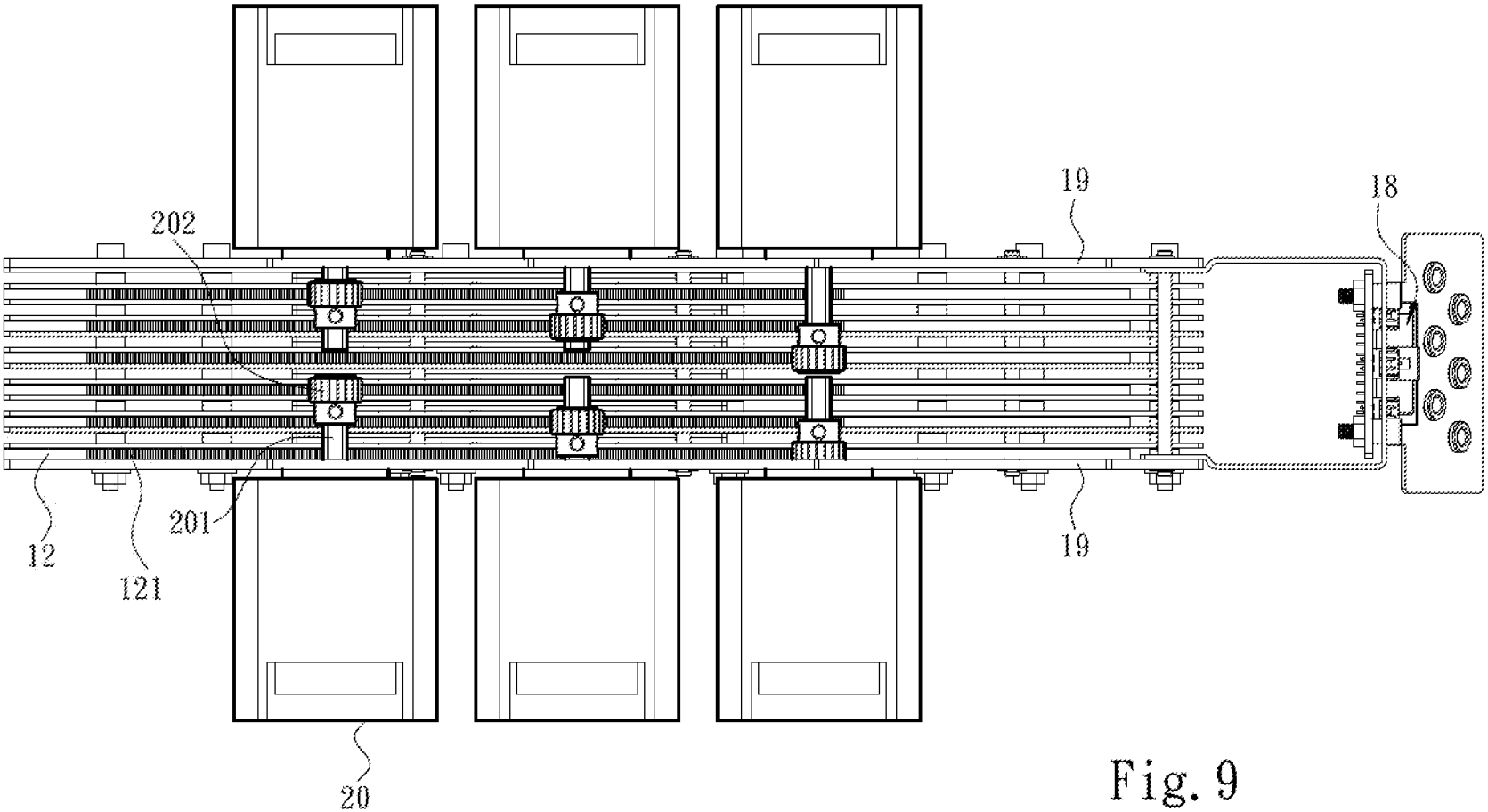
FIG. 9 is a top schematic diagram of a structure according to another embodiment of the present invention.

There are numerous embodiments for implementing the present invention. Again referring to FIG. 2 and FIG. 3, in one embodiment, each driving unit 11 may be a pneumatic tank. Further, the pneumatic tank includes a tank 111 and a pushing rod 112 penetrating the tank 111. To adapt to the pneumatic tank structure, in the present invention, each of the impelling plates 12 includes two of the connecting portions (121, 124), which are spaced and respectively connected the ends of the pushing rod 112. Thus, when the pushing rod 112 performs telescopic motions, the two connecting portions (121, 124) are driven and moved to further push the impelling plate 12. Referring to FIG. 8 and FIG. 9, in addition to the foregoing embodiments, the driving unit 11 may also be a stepping motor 20. An output shaft 201 of the stepping motor 20 may be provided with a gear 202, and the connecting portion 121 of the impelling plate 12 may be implemented by a rack. When the stepping motor 20 is activated, the gear 202 pushes the connecting portion 121 implemented in form of a rack to move the impelling plate 12.

Figure 3:
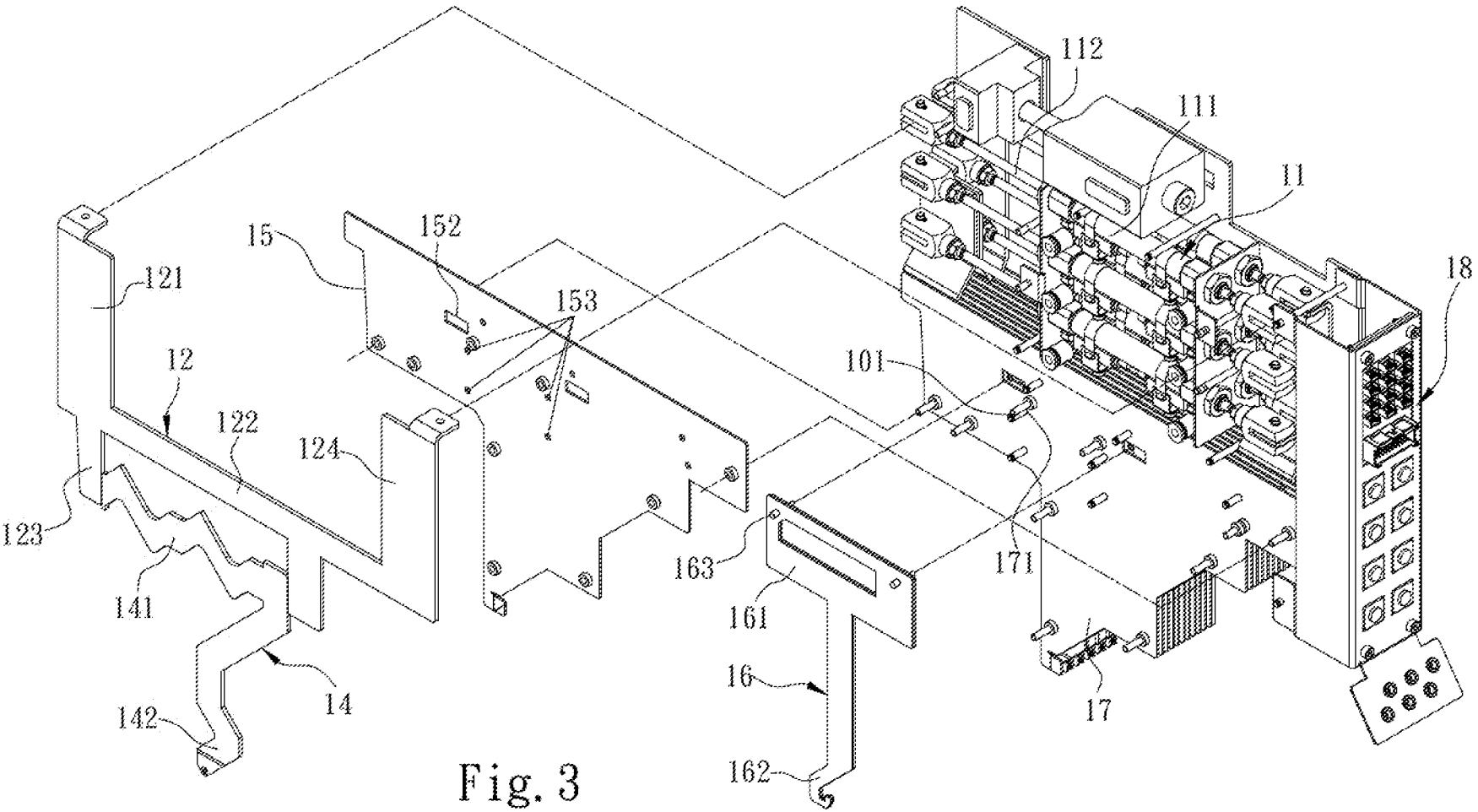
FIG. 3 is a second exploded schematic diagram of a partial structure according to an embodiment of the present invention.
Figure 4:
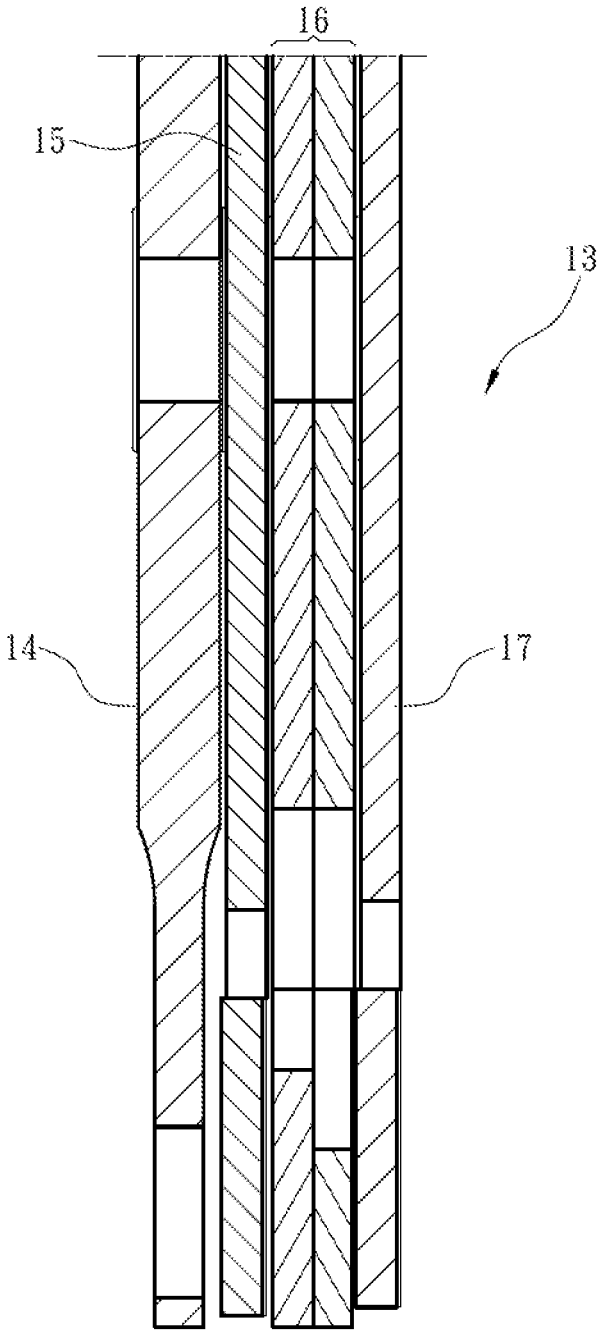
FIG. 4 is a sectional schematic diagram of a partial structure of a yarn feeding unit according to an embodiment of the present invention.
Figure 5:
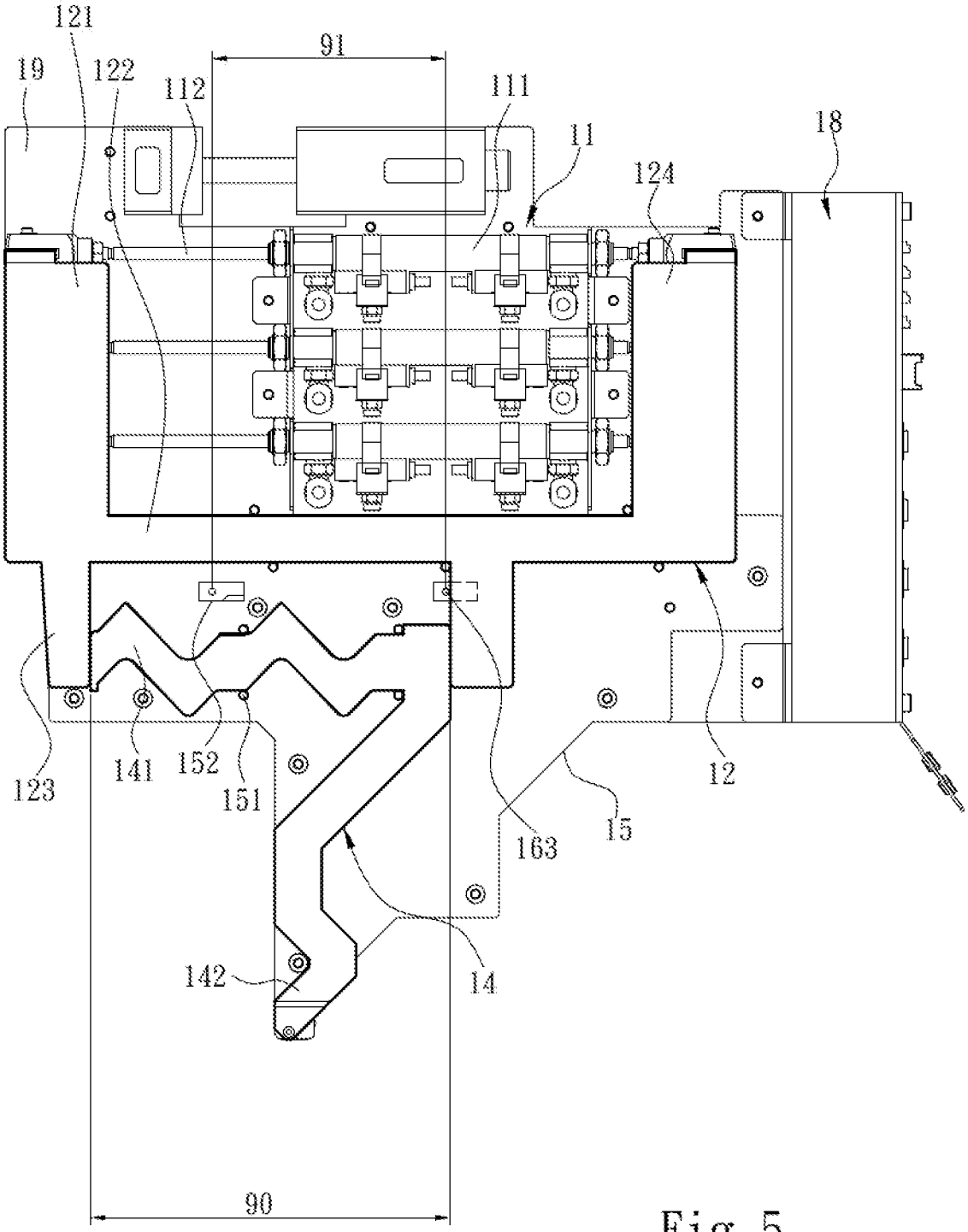
FIG. 5 is a schematic diagram of a partial structure according to an embodiment of the present invention.

Referring to FIG. 3, to simplify the structure of the electronic yarn changing device 10, in one embodiment, the yarn clamping plate 15 and the fixed blade plate 17 respectively comprise a plurality of installation holes (153, 171). Each of the plurality of guide columns 151 is formed by a horizontal shaft penetrated through the plurality of installation holes (153, 171) which are located on the same axis line. With the above implementation, the overall structural strength of the electronic yarn changing device 10 can be further enhanced.

What is claimed is:

1. An electronic yarn changing device for a circular knitting machine, comprising:

at least two driving units, individually controlled by an electronic signal;

at least two impelling plates, respectively assembled to the driving units, respectively driven by the driving units to perform a one-dimensional motion, each of the impelling plates comprising at least one connecting portion mounted with the driving unit, an extension portion extending from the connecting portion and parallel to a motion direction of the impelling plate, and two pushing portions individually extending from the extension portion, spaced by a first distance and perpendicular to the motion direction of the impelling plate; and at least two yarn feeding units, arranged side by side, each of the yarn feeding units provided sequentially with a yarn feeding plate, a yarn clamping plate, a mobile blade plate and a fixed blade plate, wherein, the yarn feeding plate comprises a curved portion having a length equal to the first distance and parallel to the motion direction of the impelling plate, and a yarn feeding portion extending from the curved portion and perpendicular to the motion direction of the impelling plate, the yarn clamping plate comprises a plurality of guide columns disposed correspondingly to the curved portion such that the yarn feeding plate pushed by the impelling plate is caused to perform a two-dimensional motion, and two through holes correspondingly provided between two pushing portions, the mobile blade plate comprises a body portion, a cutting blade portion extending from the body portion and perpendicular to the motion direction of the impelling plate, and two control rods provided on the body portion and respectively protruding towards the two through holes to cause the mobile blade plate to be impelled by one of the pushing portions and to perform a one-dimensional motion, and a second distance smaller than the first distance is present between the two control rods.

2. The electronic yarn changing device for a circular knitting machine of claim 1, wherein each of the driving units is a pneumatic tank.

3. The electronic yarn changing device for a circular knitting machine of claim 2, wherein the pneumatic tank includes a tank and a pushing rod penetrating the tank, and each of the impelling plates comprises two of the connecting portions that are spaced and respectively connected to ends of the pushing rod.

4. The electronic yarn changing device for a circular knitting machine of claim 3, wherein the yarn clamping plate and the fixed blade plate respectively comprise a plurality of installation holes, and each of the plurality of guide columns is formed by a horizontal shaft penetrated through the plurality of installation holes which are located on the same axis line.

5. The electronic yarn changing device for a circular knitting machine of claim 2, wherein the yarn clamping plate and the fixed blade plate respectively comprise a plurality of installation holes, and each of the plurality of guide columns is formed by a horizontal shaft penetrated through the plurality of installation holes which are located on the same axis line.

6. The electronic yarn changing device for a circular knitting machine of claim 1, wherein the driving units are arranged in a matrix.

7. The electronic yarn changing device for a circular knitting machine of claim 6, further comprising two protective casing plates, which are disposed on two opposite outer sides of the yarn feeding units, respectively.

8. The electronic yarn changing device for a circular knitting machine of claim 2, wherein the driving units are arranged in a matrix.

9. The electronic yarn changing device for a circular knitting machine of claim 1, further comprising an electrical control unit connected to the driving units.

10. The electronic yarn changing device for a circular knitting machine of claim 2, further comprising an electrical control unit connected to the driving units.

11. The electronic yarn changing device for a circular knitting machine of claim 1, wherein each of the driving units is a stepping motor.

12. The electronic yarn changing device for a circular knitting machine of claim 11, wherein the stepping motor comprises an output shaft and a gear disposed at an end of the output shaft, and the connecting portion of the impelling plate is a rack.

* * * * *